United States Patent [19]

Adams, Sr.

[11] Patent Number: 4,991,275

[45] Date of Patent: Feb. 12, 1991

[54] ROLLER ASSEMBLY

[75] Inventor: James H. Adams, Sr., Rochester, Mich.

[73] Assignee: GTE Valenite Corporation, Troy, Mich.

[21] Appl. No.: 481,651

[22] Filed: Dec. 18, 1989

Related U.S. Application Data

[63] Continuation of Ser. No. 262,757, Oct. 26, 1988, abandoned.

[51] Int. Cl.[5] ..... B21B 27/00

[52] U.S. Cl. ..... 29/123; 29/124; 29/125; 29/132

[58] Field of Search ..... 29/123, 124, 125, 118, 29/119, 121.6, 132; 72/237, 238

[56] References Cited

U.S. PATENT DOCUMENTS

| | | | |
|---|---|---|---|
| 2,066,031 | 12/1936 | Cowan | 29/119 |
| 2,342,159 | 2/1944 | Moran | 29/119 |
| 3,902,233 | 9/1975 | Ohtsu | 29/125 |
| 4,056,873 | 11/1977 | Cassard et al. | 29/132 |
| 4,777,822 | 10/1988 | Uemura et al. | 29/132 |

*Primary Examiner*—Carl E. Hall
*Assistant Examiner*—I. Cuda
*Attorney, Agent, or Firm*—Robert E. Walter

[57] ABSTRACT

A roller assembly of the type which receives a pair of bearings for journaling the roller for rotation about a longitudinal axis, includes a ceramic member having an annular shape about the axis with an outwardly facing surface and an inwardly facing surface positioned between respective ends of the ceramic member. A pair of end flanges engage the ends of the ceramic member and are interconnected for holding the ceramic member under a compressive force in both the longitudinal and radial direction.

1 Claim, 1 Drawing Sheet

ROLLER ASSEMBLY

This is a continuation of copending application Ser. No. 07/262,757, filed on Oct. 26, 1988, abandoned.

FIELD OF THE INVENTION

The present invention relates to roller assemblies adapted for receiving bearings for rotation about a longitudinal axis.

BACKGROUND OF THE INVENTION

Roller assemblies in the form of roll guides are used in the steel industry to direct the metal product being formed. Typically four roll guides are used in pairs with one pair giving horizontal control and another pair giving vertical control. Roll guides made of conventional steel material have a short life due to the heat, the environment, and stresses induced during metal forming operations.

In the past, roll guides have also been made from thermal resistant ceramic materials. These ceramic roll guides were of a single piece construction with pockets formed in the inside diameter to accept a bearing race. Although these ceramic guides outlast the steel guides from a wear standpoint, there is a tendency for the ceramic guides to crack and break.

U.S. Pat. No. 3,847,260 to Fowler describes a cylindrical roller rotatably supported on a stationary shaft having an end bearing and supporting a relatively thick cylinder of a ceramic material or a single elongated ceramic cylinder mounted on steel sleeve which includes end bearings. Both Fowler and the ceramic roll guide previously described rely upon pressing or otherwise interference fitting bearings or sleeves in contact with the ceramic.

SUMMARY OF THE INVENTION

It is an object of the present invention to have an improved roll guide of the type having a ceramic surface.

It is an object of the present invention to lessen the strain of the bearing races on a roll guide.

It is a further object of the present invention to configure roll guide in such a manner that the ceramic portion is under a compressive force.

It is a further object of the present invention to have a composite roll guide wherein undamaged portions can be reused.

It is a further object of the present invention to have a composite roll guide wherein various parts can be interchangeably used to give a resulting roller having different surface contours.

It is an object of the present invention to obviate one or more disadvantages of the prior art.

Other and further objects of the present invention will be apparent to one of ordinary skill in the art from reading of the detailed specification.

In accordance with the present invention, a roller assembly is of the type being adapted to receive a pair of bearings for journaling the roller for rotation about a longitudinal axis. The roller assembly comprises a ceramic member having an annular shape about the axis of rotation with an outwardly facing surface and an inwardly facing surface positioned between respective ends of the ceramic member. A pair of metal end flanges are provided with each flange engaging a respective end of the ceramic member and being interconnected for holding the ceramic member under a compressive force along an axial and radial direction. The ends of the roller assembly are adapted to receive a bearing.

DETAILED DESCRIPTION OF THE DRAWINGS

DETAILED DESCRIPTION OF THE PREFERRED EMBODIMENT

Figure 1:
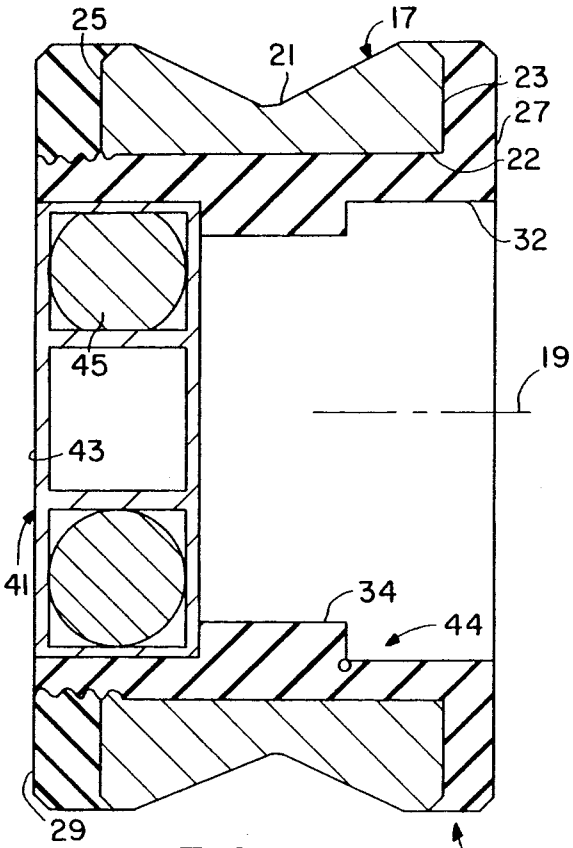
FIG. 1 is a side elevational view in section of the roller assembly of the present invention.

As shown in FIG. 1, the roller assembly or roller guide 15 comprises a ceramic member 17 having an annular shape about the axis of rotation 19 with an outwardly facing surface 21 and an inwardly facing surface 22 positioned between respective ends 23, 25 of the ceramic member. FIG. 1 illustrates a ceramic member 17 having a cylindrical surface contour at the outward surface 19 while FIG. 2 illustrates a ceramic member 17 having a surface contour tapering inwardly from the respective ends 23, 25.

Typical ceramic materials for forming the ceramic member include silicon nitride, SIALON, silicon carbide, aluminum oxide, and zirconium oxide. A preferred material of construction for the ceramic member 17 is silicon nitride which can be fabricated by techniques known in the art. Typically silicon nitride materials have a microstructure comprising a silicon nitride phase with an intergranular phase comprising an effective amount of a densification aid such as aluminum oxide, silicon dioxide, magnesium oxide, yttrium oxide, hafnium oxide, zirconium oxide, the lanthanide rare earth oxides, and mixtures thereof. It is contemplated that the silicon nitride material may include additional granular phases which may contribute to the desirable properties of the ceramic member. It is also contemplated that the silicon nitride material may include additional materials in the form of additives or impurities which tend to concentrate in the intergranular phase.

A pair of interconnecting metal end flanges 27, 29 are provided with each flange engaging a respective end of the ceramic member 17 for holding the ceramic member 17 under an a compressive force. The compressive holding of the ceramic member 17 is in both the axial and radial direction. Along the axial direction, the flanges 27, 29 are compressibly interconnected along the axis of rotation 19. The flanges 27, 29 which are preferably made of D2 type steel material are interconnected by an arbor 31 of the same material. As illustrated in FIGS. 1 and 2, the arbor 31 is cylindrically shaped with an outer peripheral surface appropriately spaced from the axis of rotation. As shown in detail in FIG. 2, the arbor 31 is fixedly mounted at one end or forms a unitary part in conjunction with flange 27. The other end of the arbor 31 projects through the opening in the ceramic member to engage the other flange 29. Arbor 31 makes a threading engagement with flange 29 due to the exterior threads 33 on the arbor 31 engaging the interior threads 35 on the flange 29. This structure permits the ceramic member 17 to be compressibly held between the flanges 27, 29 and by turning one flange with respect to the other, the compressibly force can be adjusted.

Figure 3:
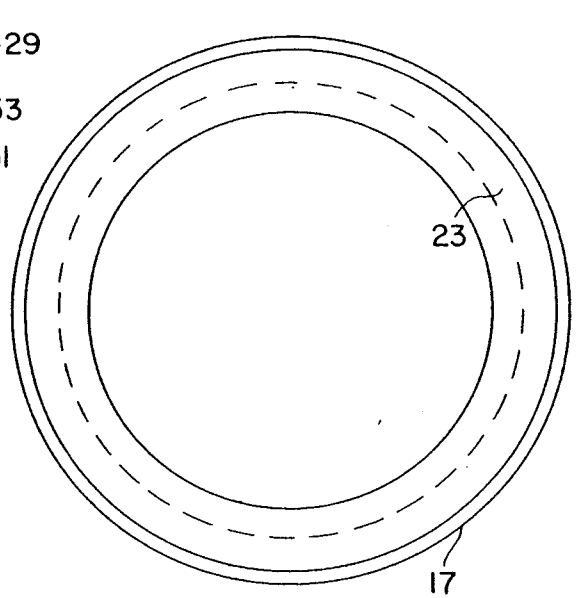
FIG. 3 is an end view of the ceramic member shown in FIG. 2.
Figure 2:
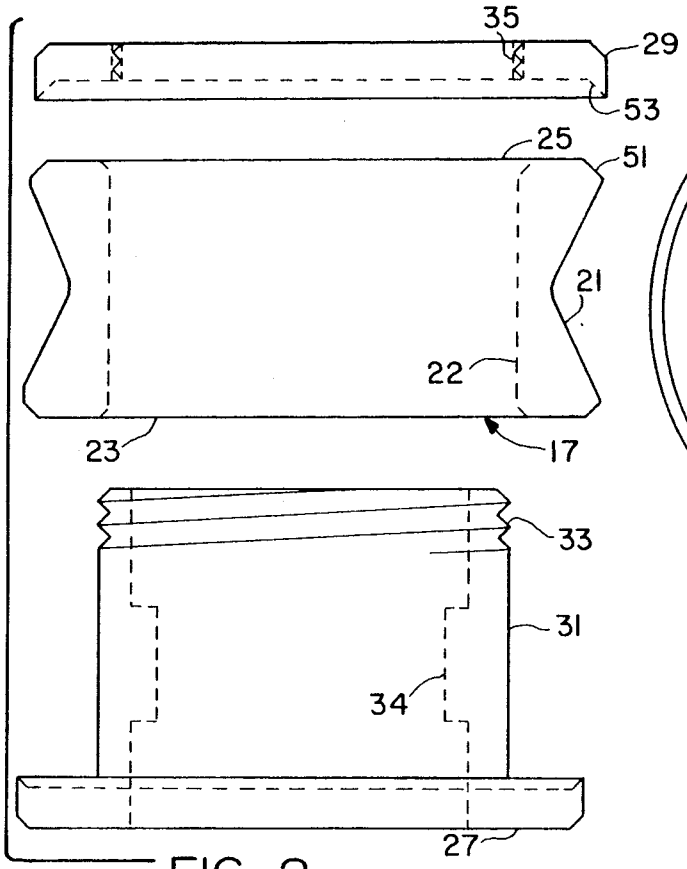
FIG. 2 is an assembly view of the roller assembly of FIG. 1.

Although FIG. 2 as set forth above describes the arbor 31 as forming a unitary part in conjunction with flange 27, it is contemplated that the flanges 27, 29 may each have internal threads for connection to a respective threaded end of arbor 31. In this case, the arbor 31 would be a separate part having a pair of externally threaded ends instead of the single threaded end as shown in the drawings.

Also, in accordance with the principles of the present invention, the ceramic member 17 is compressively held in the radial direction as well as the axial direction. As illustrated in FIG. 2, the ceramic member 17, at each of the respective ends, includes a chamfer 51 extending entirely around the periphery of the outwardly facing surface 21. The chamfers, one of which is illustrated at 51, are positioned at the juncture of the outwardly facing surface 21 and the respective flat ends 23, 25. Each of the flanges 27, 29 include a depression 53 at the respective ends thereof matching the contour of the chamfer 51 whereby the respective depression 53 and chamfer 51 match and exert a radial force on the ceramic member 17 as the flanges 27, 29 are compressively drawn together. The radial force on the ceramic member 17 is directed inwardly from the periphery of the outwardly facing surface 21 toward the longitudinal axis or axis of rotation 19. Due to this configuration, it is preferable that the surface 32 of the arbor 31 exert little or no radial force on the inwardly facing surface 21 of the ceramic member 17. In accordance with a preferred configuration, although being closely adjacent, it is preferred that the inside diameter of the ceramic member 17 be slightly larger than the outside diameter of the arbor 31 so that inwardly radial compressive forces on the exterior of the ceramic member 17 are assured. According to a most preferred embodiment, the chamfer 51 on the ceramic member 17 is from about 0.047 to about 0.057 inch at an angle of about 45 degrees. The depression or countersunk configuration 53 on the respective flanges 27, 29 most preferably match the outside diameter of the ceramic member 17 and are held to about 0.057 to about 0.067 inch depth. These dimensions are merely illustrative of a working mode of the invention and are not intended to limit the scope of the invention as described in the appended claims.

The arbor or portion 27 is adapted to receive two bearing assemblies, one of which is shown at 41. The bearing assembly 41 includes a race 43 and ball or roller bearings 45. The arbor 31 has an interior opening on either end forming an interior surface 32 which is spaced from the axis of rotation 19. A radially extending projection 34 extends from the interior surface 32 into the interior opening to form a recess for accommodating the race 43 and maintaining the spacing between bearings. One recess 44 as shown in FIG. 1 is associated with flange 27 and another recess is similarly provided with respect to flange 29 so a pair of bearing assemblies may be accommodated for each roller assembly 15.

While preferred embodiments of this invention have been described and illustrated, it is to be recognized that modifications and variations thereof may be made without departing from the spirit and scope of this invention as described in the appended claims.

I claim:

1. A roller assembly of the type including a pair of bearings at either end thereof for journaling a roller for rotation about a longitudinal axis, said roller assembly comprising a ceramic member having an annular shape about the axis of rotation, said ceramic member having a first and a second end surface, said first and said second end surfaces being substantially flat and extending substantially perpendicular to the longitudinal axis, said ceramic member having an outwardly facing surface facing away from the longitudinal axis and an inwardly facing surface facing toward the longitudinal axis, said outwardly facing surface and said inwardly facing surface extending between said first and said second end surfaces, said outwardly facing surface joining said first end surface and joining said second end surface, a first chamfer and a second chamfer, said first chamfer being at the juncture of said first end surface and said outwardly facing surface, said second chamfer being at the juncture of said second end surface and said outwardly facing surface, said chamfers extend entirely around the periphery of said outwardly facing surface, a first and a second metal end flange, said first end flange including a first depression therein matching the contour of said first chamfer, said second flange including a second depression therein matching the contour of said second chamfer, said first flange including an arbor extending along the longitudinal axis inwardly of said inwardly facing surface, said arbor threadingly engaging said second flange, said first flange engaging said first chamfer, said second flange engaging said second chamfer, said threading engagement of said arbor with said second flange holding the ceramic member under a compressive force at said respective chamfers whereby said force extends both in an axial and in a radial direction, a first and second bearing assemblies, said first bearing assembly being journaled in said first flange and said second bearing assembly being journaled in said second flange.

* * * * *